US011629879B2

(12) United States Patent
Liu et al.

(10) Patent No.: US 11,629,879 B2
(45) Date of Patent: Apr. 18, 2023

(54) SEALING PLATE ASSEMBLY AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Gang Liu, Foshan (CN); Jingqiang Jiang, Foshan (CN)

(73) Assignees: GD MIDEA AIR CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 1277 days.

(21) Appl. No.: 16/101,269

(22) Filed: Aug. 10, 2018

(65) Prior Publication Data

US 2019/0024934 A1 Jan. 24, 2019

Related U.S. Application Data

(63) Continuation of application No. PCT/CN2017/105036, filed on Sep. 30, 2017.

(30) Foreign Application Priority Data

Jul. 20, 2017 (CN) ..... 201710597267.7

(51) Int. Cl.
*F24F 13/02* (2006.01)

(52) U.S. Cl.
CPC ..... *F24F 13/0227* (2013.01); *F24F 13/0236* (2013.01); *F24F 13/0245* (2013.01); *F24F 13/0254* (2013.01)

(58) Field of Classification Search
CPC ..... F24F 13/0227; F24F 13/0236; F24F 13/0245; F24F 13/0254
(Continued)

(56) References Cited

U.S. PATENT DOCUMENTS 100,429 A * 3/1870 Maine ..... E06B 7/03 454/223
1,472,967 A * 11/1923 Enkler ..... E06B 7/03 16/DIG. 40
(Continued)

FOREIGN PATENT DOCUMENTS

CN 202361583 U 8/2012
CN 203671110 U 6/2014
(Continued)

OTHER PUBLICATIONS

Midea, International Search Report, PCT/CN2017/105036, dated Apr. 23, 2018, 4 pgs.
(Continued)

*Primary Examiner* — Allen R. B. Schult
(74) *Attorney, Agent, or Firm* — Morgan, Lewis & Bockius LLP

(57) ABSTRACT

The present application provides a sealing plate assembly and an air conditioner having thereof. The sealing plate assembly includes a first sealing plate and a second sealing plate mounted on one side of the first sealing plate. The two sealing plates can slide relative to each other. There is a sealing plate joint provided with a vent hole mounted on the first sealing plate and located at the end opposite to the end where the second sealing plate slides out of the first sealing plate. A connector is used for connecting the first sealing plate to the sealing plate joint, such that the first sealing plate and the sealing plate joint can rotate relatively by using the connector as the axis. A telescopic sealing plate assembly is formed through a relative sliding of the two sealing plates to adapt to the sizes of different windows.

18 Claims, 4 Drawing Sheets

(58) Field of Classification Search
USPC ..... 277/590
See application file for complete search history.

(56) References Cited

U.S. PATENT DOCUMENTS

| | | | | |
|---|---|---|---|---|
| 1,954,017 | A | 4/1934 | Manning | |
| 4,081,915 | A | 4/1978 | Materniak nee Babcerowicz et al. | |
| 2019/0212028 | A1* | 7/2019 | Zemborain | F24F 13/0254 |

FOREIGN PATENT DOCUMENTS

| | | | |
|---|---|---|---|
| CN | 204268586 | U | 4/2015 |
| CN | 206959272 | U | 2/2018 |
| KR | 20160142612 | A | 12/2016 |

OTHER PUBLICATIONS

Midea Group Co., Ltd., CA Office Action, Canadian Patent Application No. 3,013,752, dated Jun. 18, 2019, 3 pgs.
Midea Group Co., Ltd., WO, PCT/CN2017/105036, dated Apr. 23, 2018, 3 pgs.
Midea Group Co., Ltd., IPRP, PCT/CN2017/105036, dated Jan. 21, 2020, 4 pgs.

* cited by examiner

SEALING PLATE ASSEMBLY AND AIR CONDITIONER

PRIORITY CLAIM AND RELATED APPLICATION

The present application is a continuation of PCT/CN2017/105036 filed on Sep. 30, 2017, entitled "SEALING PLATE ASSEMBLY AND AIR CONDITIONER" which claims priority to Chinese Patent Application No. 201710597267.7 filed at Chinese Patent Office on Jul. 20, 2017, and entitled "SEALING PLATE ASSEMBLY AND AIR CONDITIONER", the entirety of both of which is herein incorporated by reference.

TECHNICAL FIELD

The present disclosure relates to the field of air conditioning technology, and particularly, to a sealing plate assembly and an air conditioner.

BACKGROUND

In related technologies, during the use of a portable air conditioner, hot air after heat exchange needs to be discharged to the outside through an exhaust pipe. The end of the exhaust pipe is connected to a sealing plate placed on a window to seal the window. However, since different customers' window sizes and forms are diverse, the conventional portable air conditioner requires a customer to splice two sealing plates in order to adapt to the size of the window. This process is cumbersome, the workload is heavy, and the user experience is seriously affected.

SUMMARY

The present disclosure aims to solve at least one of the technical problems in the prior art.

Thus, a first aspect of the present disclosure provides a sealing plate assembly that is adjustable in length.

A second aspect of the present disclosure provides an air conditioner having the sealing plate assembly.

In view of this, according to an embodiment in the first aspect of the present disclosure, a sealing plate assembly for an air conditioner, includes: a first sealing plate and a second sealing plate mounted on one side of the first sealing plate. The first sealing plate and the second sealing plate can slide relatively to each other. A sealing plate joint is mounted on the first sealing plate, located at one end of the first sealing plate opposite to another end of the first sealing plate where the second sealing plate slides out of the first sealing plate, and provided with a vent hole. A connector is used for connecting the first sealing plate to the sealing plate joint, such that the first sealing plate and the sealing plate joint can rotate relatively by taking the connector as the axis.

Further, the second sealing plate slides into or out of the range of the first sealing plate so as to adapt to the sizes of different windows. Specifically, the second sealing plate can slide into or out of one end of the first sealing plate to form a telescopic sealing plate assembly. In addition, the operation process is simple, time and labor being saved and therefore the user experience improved. At the same time, the sealing plate joint is arranged at the other end of the first sealing plate, opposite to the end where the second sealing plate slides out. The sealing plate joint is provided with a vent hole, and the first sealing plate is connected to the sealing plate joint through the connector to implement relative bending of the first sealing plate and the sealing plate joint, i.e., the folding of the sealing plate assembly is achieved. Thus, the compact structure of the sealing plate assembly is ensured, the overall length of the sealing plate assembly is reduced, the loading quantity is improved, and the sealing plates can cooperate with an air conditioner body to achieve storage.

In addition, the sealing plate assembly provided by the present disclosure in the above embodiment may also have the following additional technical features:

In the above technical solution, the connector is one selected from the group consisting of a hinge, a rotating shaft, a rubber member and a plastic member; and the rotatable angle of connector ranges from 0 to 180 degrees, preferably, from 0 to 90 degrees, so that the sealing plates cooperate with the air conditioner body to achieve storage.

In some embodiments, the sealing plate assembly further includes: a first sliding chute, arranged in the first sealing plate, the first sliding chute having an opening facing the second sealing plate; a second sliding chute, arranged in the sealing plate joint to engage the first sliding chute; and a latch, matched with the first sliding chute and the second sliding chute. The latch is longer than the second sliding chute, and the latch can access or retreat from the first sliding chute when the sealing plate joint is rotated to be parallel to the first sealing plate.

In this technical solution, the first sliding chute is arranged in the first sealing plate, the second sliding chute is arranged in the sealing plate joint, the first sliding chute is in butt joint with the second sliding chute when the first sealing plate and the sealing plate joint are rotated to be parallel, and the latch is arranged in the first sliding chute and slides between the first sliding chute and the second sliding chute to fix the first sliding chute and the second sliding chute, thereby preventing a gap between the sealing plate assembly and the window due to the relative rotation of the first sealing plate and the sealing plate joint from affecting the sealing effect. Specifically, when the first sealing plate and the sealing plate joint are rotated to be parallel, the latch is pushed into the second sliding chute, and the latch which is longer than the second sliding chute supports the first sealing plate and the sealing plate joint, thereby avoiding the relative rotation of the both; when the user wants to store the sealing plate assembly, only the latch is pulled out of the second sliding chute, and the first sealing plate and the sealing plate joint can be rotated relatively.

In some embodiments, preferably, the sealing plate assembly further includes: a stop plate, arranged on the first sealing plate and located at a side opposite the first sliding chute, a third sliding chute being arranged in the middle of the stop plate, and part of the first sliding chute being configured to engage the third sliding chute; wherein the part of the first sliding chute matched with the third sliding chute penetrates the first sealing plate, and the latch penetrates part of the first sliding chute to engage the third sliding chute.

In this technical solution, the stop plate is arranged on the first sealing plate, the third sliding chute is arranged in the middle of the stop plate, the latch penetrates part of the first sliding chute and is located in the third sliding chute, the latch can abut against the side edge of the stop plate since the third sliding chute is located in the middle of the stop plate, then the latch is stopped, the latch is ensured to be always located near the sealing plate joint, the user can conveniently insert or draw the latch into or out of the second sliding chute, and the latch is prevented from falling to a position far from the sealing plate joint, so that the user experience is improved.

In some embodiments, the stop plate and the connector are either an integrated structure or a split structure.

In this technical solution, the stop plate may be configured into an integrated structure with the connector or mounted on the first sealing plate alone.

In some embodiments, at least one sliding support is arranged on the first sealing plate; the sliding support includes: a connecting portion, arranged on the first sealing plate; and a stop portion, arranged on the connecting portion; wherein, the stop portion is wider than the connecting portion; and the second sealing plate is provided with a sliding chute, and the sliding chute is configured to engage the sliding support to cause a relative sliding between the first sealing plate and the second sealing plate.

In this technical solution, the first sealing plate and the second sealing plate are guided and positioned through cooperation of the sliding support and the sliding chute. During installation, the sliding chute is aligned with the sliding support, and the second sealing plate is then caused to slide into the first sealing plate to complete the installation.

In some embodiments, the first sealing plate, the second sealing plate and the sealing plate joint have the same width.

In this technical solution, the first sealing plate, the second sealing plate and the sealing plate joint are set to have the same width, thereby ensuring the airtightness between the sealing plate assembly and the window and ensuring the cooling or heating effect of an air conditioner.

In some embodiments, preferably, the sealing plate assembly further includes: bent structures, arranged on two sides of the first sealing plate, and facing a middle of the first sealing plate; convex ribs, arranged at the ends of the bent structures, and extending toward the second sealing plate; and grooves, arranged on two sides of the second sealing plate, the convex ribs being configured to engage the grooves.

In this technical solution, the bent structures are arranged on the two sides of the first sealing plate, the convex ribs are arranged at the ends of the bent structures, at the same time, the grooves matched with the convex ribs are arranged on the two sides of the second sealing plate, then edges having certain widths are formed on the two sides of the first sealing plate and the second sealing plate, and edges are formed on the two sides of the sealing plate joint, so that the sealing plate assembly cooperates with the window conveniently, the contact area between the window and the sealing plate assembly is enlarged, and further the airtightness between the window and the sealing plate assembly is ensured.

In some embodiments, the sealing plate assembly further includes: a fixing portion, arranged on the second sealing plate for fixing relative positions between the first sealing plate and the second sealing plate.

In this technical solution, the first sealing plate and the second sealing plate are fixed through the fixing portion. After the length of the sealing plate assembly is adjusted, the first sealing plate and the second sealing plate are fixed by adopting the fixing portion, thereby preventing random sliding of the first sealing plate and the second sealing plate from affecting installing the sealing plate assembly on the window by the user, facilitating installing the sealing plate assembly by the user and improving the user experience.

In some embodiments, the fixing portion includes: a fixing block, provided with a through hole; and a locking lever, penetrating the through hole to engage the first sliding chute; wherein, when rotating to a preset angle, the locking lever abuts against the two sides of the first sliding chute.

In this embodiment, the fixing block is arranged at the end of the second sealing plate close to the sealing plate joint, the locking lever is arranged in the through hole of the fixing block, and part of the locking lever is located in the first sliding chute, wherein the part of the locking lever located in the first sliding chute is of a non-circular structure, then when the locking lever is rotated, the outer wall of the locking lever extrudes the inner wall of the first sliding chute, and the first sealing plate and the second sealing plate are fixed by the friction between the first sliding chute and the locking lever, and by means of the fixing method, the sealing plate assembly is simple in structure and convenient to operate.

According to the second aspect of the present disclosure, the present disclosure provides an air conditioner, including: an air conditioner body; an air duct, having one end connected to the air conditioner body; and a sealing plate assembly as mentioned in any one of the above embodiments; wherein the vent hole is connected to another end of the air duct.

According to the air conditioner provided by the present disclosure, the air duct on the air conditioner body is connected to the sealing plate assembly as mentioned in any one of the above technical solutions, hot air is discharged to the outdoors through the air duct, and since the air conditioner of the present disclosure includes the sealing plate assembly as mentioned in any one of the above technical solutions, it has all the beneficial effects of the sealing plate assembly as mentioned in any one of the above technical solutions, which will not be described here.

Additional aspects and advantages of the present disclosure will become apparent in the following description, or may be learned by practice of the present disclosure.

BRIEF DESCRIPTION OF THE DRAWINGS

The above and/or additional aspects and advantages of the present disclosure will become apparent and be easily understood from the following description of embodiments in conjunction with the accompanying drawings, in which.

Figure 1:
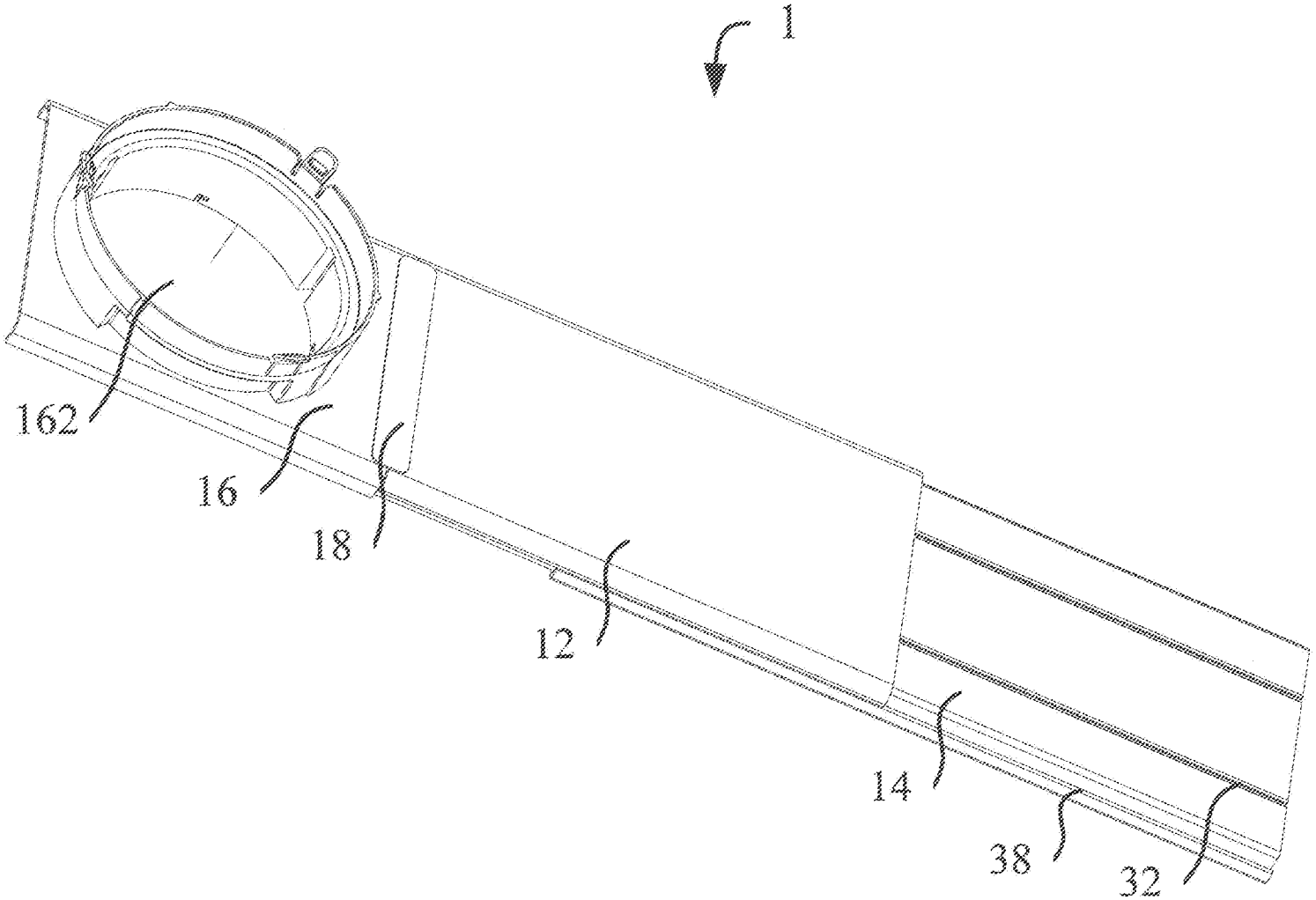
FIG. 1 shows a structure diagram of a sealing plate assembly provided by an embodiment of the present disclosure.

The correspondence between the reference signs and the component names in

FIG. 1 to FIG. 4 is:

1: sealing plate assembly, 12: first sealing plate, 14: second sealing plate, 16: sealing plate joint, 162: vent hole, 18: connector, 20: first sliding chute, 22: second sliding chute, 24: latch, 26: stop plate, 28: third sliding chute, 30: sliding support, 32: sliding chute, 34: bent structure, 36: convex rib, 38: groove, 40: fixing block, 42: locking lever.

DETAILED DESCRIPTION OF THE EMBODIMENTS

In order to understand the above objectives, features and advantages of the present disclosure more clearly, the present disclosure will be further described in detail below in conjunction with the accompanying drawings and specific embodiments. It should be noted that the embodiments of the present application and features in the embodiments can be combined with each other without conflicts.

In the following description, numerous specific details are set forth in order to fully understand the present disclosure. However, the present disclosure can also be implemented in other ways than those described herein. Therefore, the scope of the present disclosure is not limited to the specific embodiments disclosed below.

A sealing plate assembly 1 according to some embodiments of the present disclosure will be described below with reference to FIG. 1 to FIG. 4.

As shown in FIG. 1 to FIG. 4, according to an embodiment in a first aspect of the present disclosure, the present disclosure provides a sealing plate assembly 1 for an air conditioner, including: a first sealing plate 12; a second sealing plate 14, mounted on one side of the first sealing plate 12, wherein the first sealing plate 12 and the second sealing plate 14 can slide relatively; a sealing plate joint 16, mounted on the first sealing plate 12, located at the end opposite to the end where the second sealing plate 14 slides out of the first sealing plate 12, and provided with a vent hole 162; a connector 18 for connecting the first sealing plate 12 with the sealing plate joint 16, wherein the first sealing plate 12 and the sealing plate joint 16 can rotate relatively by taking the connector 18 as the axis.

According to the sealing plate assembly 1 provided by the present disclosure, the first sealing plate 12 and the second sealing plate 14 slide relatively, i.e., the second sealing plate 14 slides into or out of the range of the first sealing plate 12, specifically, the second sealing plate 14 can slide into or out of one end of the first sealing plate 12 to form a telescopic sealing plate assembly 1 so as to adapt to the sizes of different windows. In addition, the operation process is simple, time and labor are saved, and therefore the user experience is improved. At the same time, the sealing plate joint 16 is arranged at the other end of the first sealing plate 12 opposite to the end where the second sealing plate 14 slides out, the sealing plate joint 16 is provided with a vent hole 162, and the first sealing plate 12 is connected to the sealing plate joint 16 through the connector 18 to realize relative bending of the first sealing plate 12 and the sealing plate joint 16, i.e., folding of the sealing plate assembly 1 is realized, thus, the compact structure of the sealing plate assembly 1 is ensured, the overall length of the sealing plate assembly 1 is reduced, the loading quantity is improved, and the sealing plates can cooperate with an air conditioner body to achieve storage.

According to the sealing plate assembly 1 provided by the present disclosure, the first sealing plate 12 and the second sealing plate 14 slide relatively, i.e., the second sealing plate 14 slides into or out of the range of the first sealing plate 12 to form a telescopic sealing plate assembly 1 so as to adapt to the sizes of different windows. In addition, the operation process is simple, time and labor are saved, and therefore the user experience is improved. At the same time, the first sealing plate 12 and the sealing plate joint 16 are bent through the connector 18 between the first sealing plate 12 and the sealing plate joint 16 to form the foldable sealing plate assembly 1, thus, the overall sealing plate assembly 1 is foldable and telescopic and is configured to engage a window. Moreover, the sealing plate assembly 1 cooperates with the air conditioner body and is thus conveniently stored.

In one embodiment of the present disclosure, preferably, the connector 18 is at least one of a hinge, a rotating shaft, a rubber member and a plastic member; and the connector has a rotatable angle ranging from 0 to 180 degrees.

In this embodiment, the connector 18 may be a hinge, a rotating shaft, a rubber member or a plastic member, and the rotatable angle of the connector 18 ranges from 0 to 180 degrees, wherein, preferably, the rotatable angle of the connector 18 ranges from 0 to 90 degrees, so that the sealing plates cooperate with the air conditioner body to achieve storage.

Figure 3:
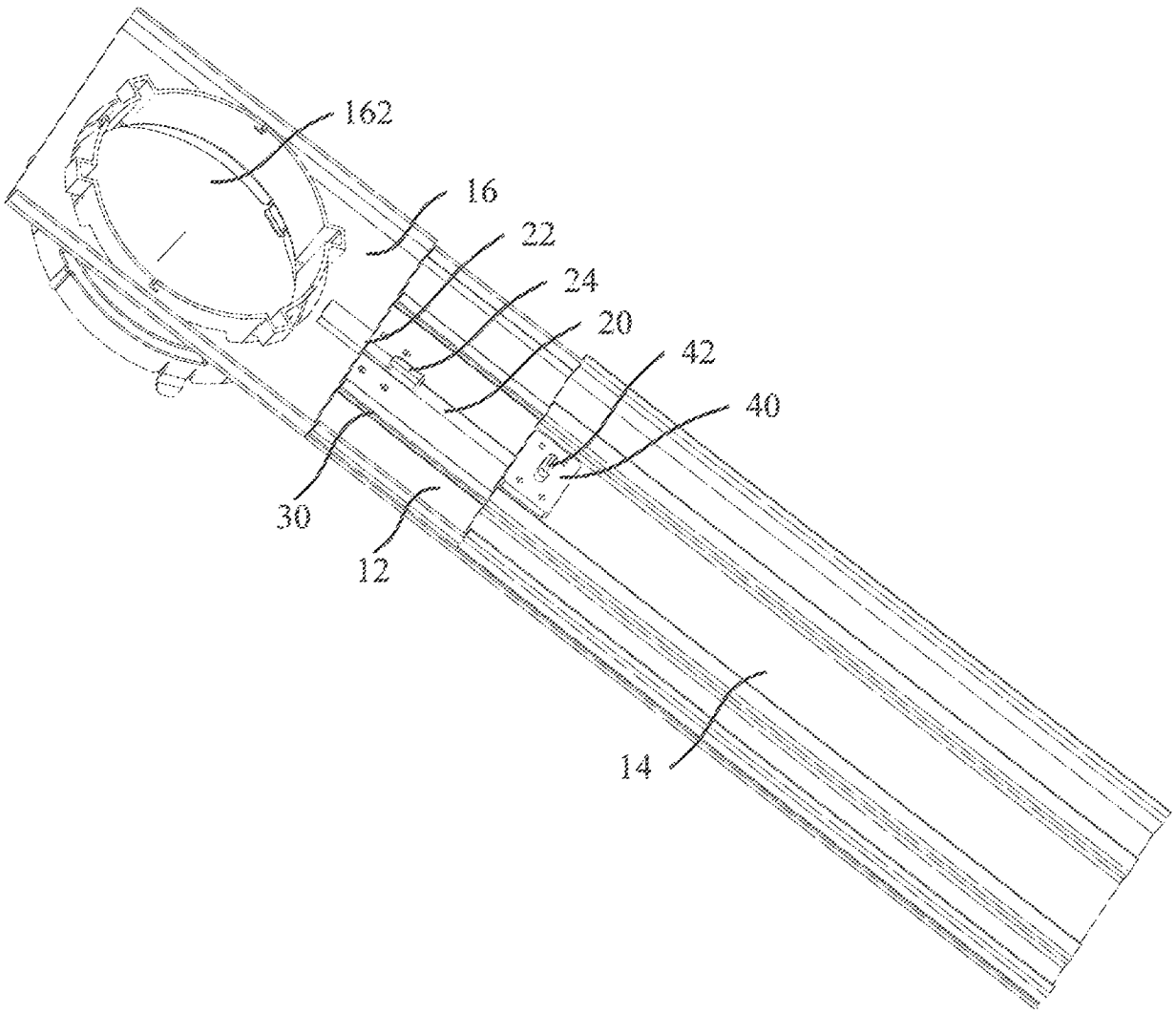
FIG. 3 shows a structure diagram of the back of the sealing plate assembly shown in FIG. 2.

In one embodiment of the present disclosure, preferably, as shown in FIG. 3, the sealing plate assembly further includes: a first sliding chute 20, arranged in the first sealing plate 12, the opening of the first sliding chute 20 facing the second sealing plate 14; a second sliding chute 22, arranged in the sealing plate joint 16 to engage the first sliding chute 20; and a latch 24, matched with the first sliding chute 20 and the second sliding chute 22; wherein the latch 24 is longer than the second sliding chute 22, and the latch 24 can access or retreat from the first sliding chute 20 when the sealing plate joint 16 is rotated to be parallel to the first sealing plate 12.

In this embodiment, the first sliding chute 20 is arranged in the first sealing plate 12, the second sliding chute 22 is arranged in the sealing plate joint 16, the first sliding chute 20 is in butt joint with the second sliding chute 22 when the first sealing plate 12 and the sealing plate joint 16 are rotated to be parallel, and the latch 24 is arranged in the first sliding chute 20 and slides between the first sliding chute 20 and the second sliding chute 22 to fix the first sliding chute 20 and the second sliding chute 22, thereby preventing a gap between the sealing plate assembly 1 and the window due to the relative rotation of the first sealing plate 12 and the sealing plate joint 16 from affecting the sealing effect. Specifically, when the first sealing plate 12 and the sealing plate joint 16 are rotated to be parallel, the latch 24 is pushed into the second sliding chute 22, and as the latch 24 is longer than the second sliding chute 22, the latch 24 supports the first sealing plate 12 and the sealing plate joint 16, thereby avoiding relative rotation of the both; when the user wants to store the sealing plate assembly 1, only the latch 24 is pulled out of the second sliding chute 22, and the first sealing plate 12 and the sealing plate joint 16 can be rotated relatively.

In a specific embodiment, the first sliding chute 20 and the second sliding chute 22 may also be provided as a first sliding support and a second sliding support. At the same time, the latch 24 is replaced with a sleeve, which is sleeved on the first sliding support and the second sliding support.

In a specific embodiment, the second sliding chute 22 may be of a hole structure or of an open groove 38 structure.

Figure 2:
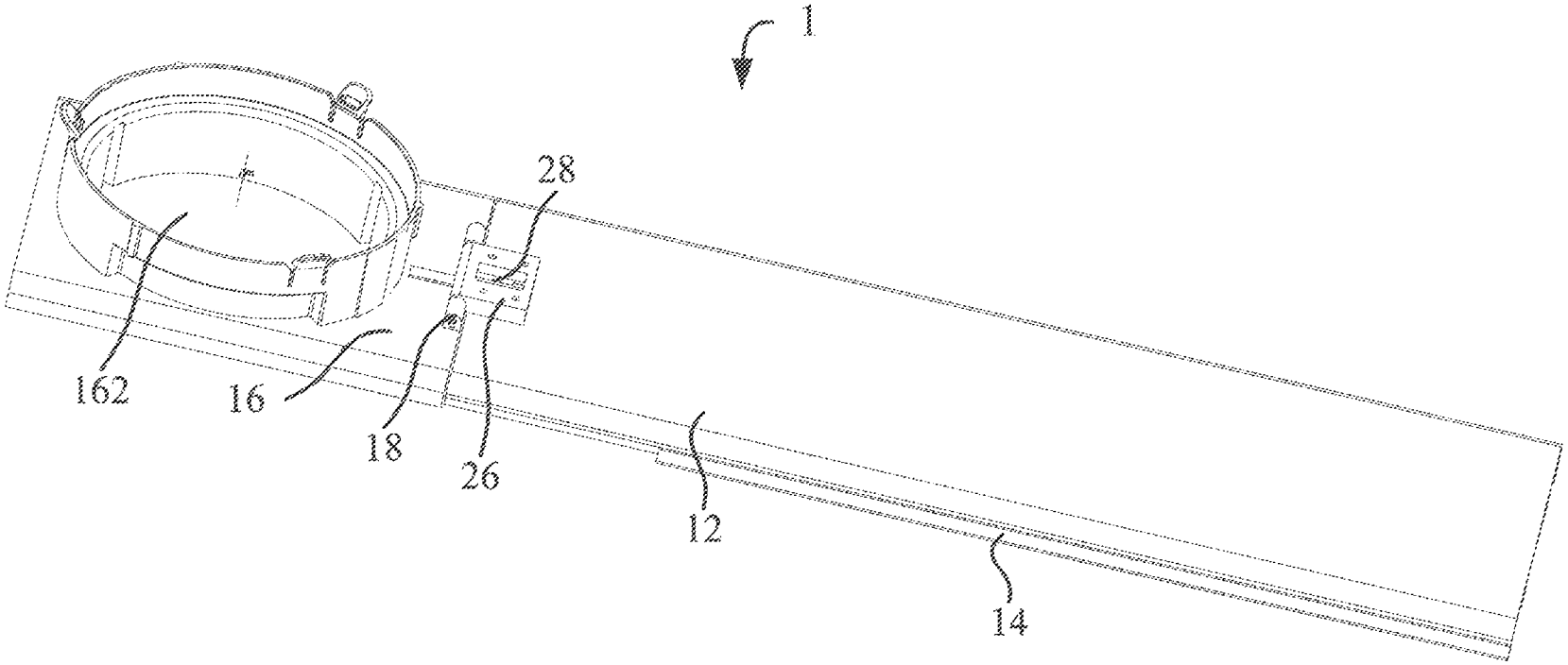
FIG. 2 shows a structure diagram of a sealing plate assembly provided by another embodiment of the present disclosure.

In one embodiment of the present disclosure, preferably, as shown in FIG. 2, the sealing plate assembly further includes: a stop plate 26, arranged on the first sealing plate 12 and located at a side opposite the first sliding chute 20, a third sliding chute 28 being arranged in the middle of the stop plate 26, and part of the first sliding chute 20 being configured to engage the third sliding chute 28; wherein the part of the first sliding chute 20 matched with the third sliding chute 28 penetrates the first sealing plate 12, and the latch 24 penetrates part of the first sliding chute 20 to engage the third sliding chute 28.

In this embodiment, the stop plate 26 is arranged on the first sealing plate 12, the third sliding chute 28 is arranged in the middle of the stop plate 26, the latch 24 penetrates part of the first sliding chute 20 and is located in the third sliding chute 28, the latch 24 can abut against the side edge of the stop plate 26 since the third sliding chute 28 is located in the middle of the stop plate 26, then the latch 24 is stopped, the latch 24 is ensured to be always located near the sealing plate joint 16, the user can conveniently insert or draw the latch 24 into or out of the second sliding chute 22, and the latch 24 is prevented from falling to a position far from the sealing plate joint 16, so that the user experience is improved.

In one embodiment of the present disclosure, preferably, as shown in FIG. 2, the stop plate 26 and the connector 18 are of an integrated structure.

In this embodiment, the stop plate 26 may be configured into an integrated structure with the connector 18, thereby simplifying the assembly steps and improving the production efficiency.

In another embodiment of the present disclosure, the stop plate 26 is preferably mounted on the first sealing plate 12 alone.

Figure 4:
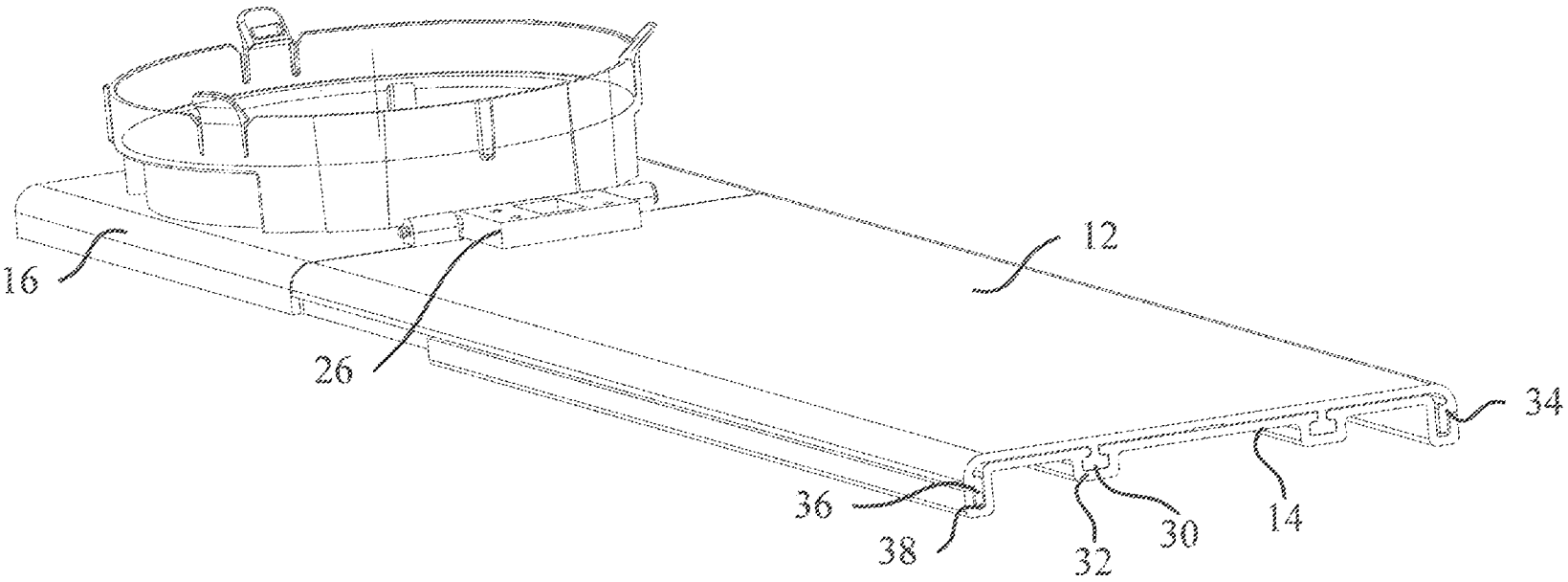
FIG. 4 shows a structure diagram of the bottom of the sealing plate assembly shown in FIG. 2.

In one embodiment of the present disclosure, preferably, as shown in FIG. 4, at least one sliding support 30 is arranged on the first sealing plate 12. The sliding support 30 includes: a connecting portion, arranged on the first sealing plate 12; and a stop portion, arranged on the connecting portion; wherein, the stop portion is wider than the connecting portion; and the second sealing plate 14 is provided with a sliding chute 32, and the sliding chute 32 is configured to engage the sliding support 30 to realize relative sliding of the first sealing plate 12 and the second sealing plate 14.

In this embodiment, the first sealing plate 12 and the second sealing plate 14 are guided and positioned through matching of the sliding support 30 and the sliding chute 32. During installation, the sliding chute 32 is aligned with the sliding support 30, and the second sealing plate 14 is then caused to slide into the first sealing plate 12 to complete the installation.

Of course, in a specific embodiment, the sliding support 30 may be arranged on the second sealing plate 14, and the sliding chute 32 may be arranged in the first sealing plate 12.

In one embodiment of the present disclosure, preferably, as shown in FIGS. 1 to 4, the first sealing plate 12, the second sealing plate 14 and the sealing plate joint 16 have the same width.

In this embodiment, the first sealing plate 12, the second sealing plate 14 and the sealing plate joint 16 are set to have the same width, thereby ensuring the airtightness between the sealing plate assembly 1 and the window and ensuring the cooling or heating effect of an air conditioner.

In one embodiment of the present disclosure, preferably, as shown in FIG. 4, the sealing plate assembly further includes: bent structures 34, arranged on two sides of the first sealing plate 12, and facing a middle of the first sealing plate 12; convex ribs 36, arranged at the ends of the bent structures 34, and extending toward the second sealing plate 14; and grooves 38, arranged on two sides of the second sealing plate 14, the convex ribs 36 being configured to engage the grooves 38.

In this embodiment, the bent structures 34 are arranged on the two sides of the first sealing plate 12, the convex ribs 36 are arranged at the ends of the bent structures 34, at the same time, the grooves 38 matched with the convex ribs 36 are arranged on the two sides of the second sealing plate 14, then edges having certain widths are formed on the two sides of the first sealing plate 12 and the second sealing plate 14, and edges are formed on the two sides of the sealing plate joint 16, so that the sealing plate assembly 1 cooperates with the window conveniently, the contact area between the window and the sealing plate assembly 1 is enlarged, and further the airtightness between the window and the sealing plate assembly 1 is ensured.

Of course, in a specific embodiment, the bent structures 34 and the convex ribs 36 may be arranged on the second sealing plate 14, and the grooves 38 may be arranged in the first sealing plate 12.

In one embodiment of the present disclosure, preferably, as shown in FIG. 3, the sealing plate assembly further includes: a fixing portion, arranged on the second sealing plate 14 for fixing relative positions of the first sealing plate 12 and the second sealing plate 14.

In this embodiment, the first sealing plate 12 and the second sealing plate 14 are fixed through the fixing portion. After the length of the sealing plate assembly 1 is adjusted, the first sealing plate 12 and the second sealing plate 14 are fixed by adopting the fixing portion, thereby avoiding random sliding of the first sealing plate 12 and the second sealing plate 14 to affect installation on the sealing plate assembly 1 by the user, facilitating installing the sealing plate assembly 1 by the user and improving the user experience. Preferably, the fixing portion is arranged at the edge of the second sealing plate 14 close to the sealing plate joint 16.

Of course, in a specific embodiment, the fixing portion may also be arranged on the first sealing plate 12 and located at the edge away from the sealing plate joint 16.

In one embodiment of the present disclosure, preferably, as shown in FIG. 2, the fixing portion includes: a fixing block 40, provided with a through hole; and a locking lever 42, penetrating the through hole to engage the first sliding chute 20; wherein, when rotating to a preset angle, the locking lever 42 abuts against the two sides of the first sliding chute 20.

In this embodiment, the fixing block 40 is arranged at the end of the second sealing plate 14 close to the sealing plate joint 16, the locking lever 42 is arranged in the through hole of the fixing block 40, and part of the locking lever 42 is located in the first sliding chute 20, wherein the part of the locking lever 42 located in the first sliding chute 20 is of a non-circular structure, then when the locking lever 42 is rotated, the outer wall of the locking lever 42 extrudes the inner wall of the first sliding chute 20, and the first sealing plate 12 and the second sealing plate 14 are fixed by the friction between the first sliding chute 20 and the locking lever 42, and by means of the fixing method, the sealing plate assembly is simple in structure and convenient to operate.

In a specific embodiment, a screw hole may be arranged in the middle of the fixing block 40, a screw cooperates with the screw hole, and when the first sealing plate 12 and the second sealing plate 14 are fixed, the screw is screwed into the screw hole to abut against the first sealing plate 12 so as to fix the first sealing plate 12 and the second sealing plate 14.

According to an embodiment in a second aspect of the present disclosure, the present disclosure provides an air conditioner, including: an air conditioner body; an air duct, having one end connected to the air conditioner body; and a sealing plate assembly 1 as mentioned in any one of the above technical solutions; wherein the vent hole is connected to another end of the air duct 162.

According to the air conditioner provided by the present disclosure, the air duct on the air conditioner body is connected to the sealing plate assembly 1 as mentioned in any one of the above technical solutions, hot air is discharged to the outdoors through the air duct, and since the air conditioner of the present disclosure includes the sealing plate assembly 1 as mentioned in any one of the above technical solutions, the air conditioner has all the advantages of the sealing plate assembly 1 as mentioned in any one of the above technical solutions, which will not be described here.

According to the sealing plate assembly 1 and the air conditioner provided by the present disclosure, the first sealing plate 12 and the second sealing plate 14 slide relatively, i.e., the second sealing plate 14 slides into or out of the range of the first sealing plate 12, specifically, the second sealing plate 14 can slide into or out of one end of the first sealing plate 12 to form a telescopic sealing plate assembly 1 so as to adapt to the sizes of different windows. In addition, the operation process is simple, time and labor are saved, and therefore the user experience is improved. At the same time, the sealing plate joint 16 is arranged at the other end of the first sealing plate 12 opposite to the end where the second sealing plate 14 slides out, the sealing plate joint 16 is provided with a vent hole 162, and the first sealing plate 12 is connected to the sealing plate joint 16 through the connector 18 to realize relative bending of the first sealing plate 12 and the sealing plate joint 16, i.e., folding of the sealing plate assembly 1 is realized, thus, the compact structure of the sealing plate assembly 1 is ensured, the overall length of the sealing plate assembly 1 is reduced, the loading quantity is improved, and the sealing plates can cooperate with the air conditioner body to achieve storage.

In the present disclosure, the terms "first" and "second" are merely used for the purpose of description, but cannot be understood as indicating or implying the relative importance. The terms "install", "connect", "connection", "fix" and the like all should be generally understood, for example, the "connection" may be fixed connection, detachable connection and integrated connection, and the "connected" may be directly connected or indirectly connected through a medium. Those of ordinary skill in the art can understand the specific meanings of the above terms in the present disclosure according to specific circumstances.

In the description of this specification, the terms "one embodiment", "some embodiments", "a specific embodiment" and the like mean that specific features, structures, materials or characteristics described in conjunction with the embodiments or examples are included in the at least one embodiment or example of the present disclosure. In this specification, the schematic descriptions of the above terms do not necessarily refer to the same embodiment or example. Moreover, the specific features, structures, materials or characteristics described may be combined appropriately in one or more embodiments or examples.

Described above are merely preferred embodiments of the present disclosure, and the present disclosure is not limited thereto. Various modifications and variations may be made to the present disclosure for those skilled in the art. Any modification, equivalent substitution or improvement made within the spirit and principle of the present disclosure shall fall into the protection scope of the present disclosure.

What is claimed is:

1. A sealing plate assembly for an air conditioner, comprising:

a first sealing plate;

a second sealing plate, mounted on one side of the first sealing plate, wherein the first sealing plate and the second sealing plate can slide relatively;

a sealing plate joint, mounted on the first sealing plate, located at one end of the first sealing plate opposite to another end of the first sealing plate where the second sealing plate slides out of the first sealing plate, and provided with a vent hole;

a connector for connecting the first sealing plate to the sealing plate joint, wherein the first sealing plate and the sealing plate joint can rotate relatively by taking the connector as the axis;

a first sliding chute, arranged in the first sealing plate;

a stop plate, arranged on the first sealing plate and located at a side opposite the first sliding chute;

a second sliding chute, arranged in the sealing plate joint to engage the first sliding chute;

a latch, matched with the first sliding chute and the second sliding chute; and a stop plate, arranged on the first sealing plate and located at a side opposite the first sliding chute, a third sliding chute being arranged in the middle of the stop plate, and part of the first sliding chute being configured to engage the third sliding chute, wherein the latch is longer than the second sliding chute, and the latch can access or retreat from the first sliding chute when the sealing plate joint is rotated to be parallel to the first sealing plate, and wherein the first sliding chute having an opening facing the second sealing plate.

2. The sealing plate assembly according to claim 1, wherein the connector is at least one of a hinge, a rotating shaft, a rubber member and a plastic member; and the connector has a rotatable angle ranging from 0 to 180 degrees.

3. The sealing plate assembly according to claim 1, wherein at least one sliding support is arranged on the first sealing plate;

the sliding support further comprises:

a connecting portion, arranged on the first sealing plate; and a stop portion, arranged on the connecting portion;

wherein, the stop portion is wider than the connecting portion; and and the second sealing plate is provided with a sliding chute, and the sliding chute is configured to engage the sliding support to cause a relative sliding between the first sealing plate and the second sealing plate.

4. The sealing plate assembly according to claim 1, further comprising:

bent structures, arranged on two sides of the first sealing plate and facing a middle of the first sealing plate;

convex ribs, arranged at the ends of the bent structures and extending toward the second sealing plate; and grooves, arranged on two sides of the second sealing plate, the convex ribs being configured to engage the grooves.

5. The sealing plate assembly according to claim 2, wherein at least one sliding support is arranged on the first sealing plate;

the sliding support further comprises:

a connecting portion, arranged on the first sealing plate; and a stop portion, arranged on the connecting portion;

wherein, the stop portion is wider than the connecting portion; and the second sealing plate is provided with a sliding chute, and the sliding chute is configured to engage the sliding support to cause a relative sliding between the first sealing plate and the second sealing plate.

6. The sealing plate assembly according to claim 1, wherein and the latch is configured to support and prevent relative rotation of the first sealing plate and the sealing plate joint when the latch is pushed into the second sliding chute, and wherein the first sealing plate and the sealing plate joint are configured to permit relative rotation for storage when the latch is pulled out of the second sliding chute.

7. A sealing plate assembly for an air conditioner, comprising:

a first sealing plate;

a second sealing plate, mounted on one side of the first sealing plate, wherein the first sealing plate and the second sealing plate can slide relatively;

a sealing plate joint, mounted on the first sealing plate, located at one end of the first sealing plate opposite to another end of the first sealing plate where the second sealing plate slides out of the first sealing plate, and provided with a vent hole;

a connector for connecting the first sealing plate to the sealing plate joint, wherein the first sealing plate and the sealing plate joint can rotate relatively by taking the connector as the axis;

a first sliding chute, arranged in the first sealing plate, the first sliding chute having an opening facing the second sealing plate;

a second sliding chute, arranged in the sealing plate joint to engage the first sliding chute;

a latch, matched with the first sliding chute and the second sliding chute; and a stop plate, arranged on the first sealing plate and located at a side opposite the first sliding chute, a third sliding chute being arranged in the middle of the stop plate, and part of the first sliding chute being configured to engage the third sliding chute;

wherein the latch is longer than the second sliding chute, and the latch can access or retreat from the first sliding chute when the sealing plate joint is rotated to be parallel to the first sealing plate;

and the part of the first sliding chute matched with the third sliding chute penetrates the first sealing plate, and the latch penetrates part of the first sliding chute to engage the third sliding chute.

8. The sealing plate assembly according to claim 7, wherein the stop plate and the connector are either an integrated structure or a split structure.

9. The sealing plate assembly according to claim 7, further comprising:

a fixing portion, arranged on the second sealing plate for fixing relative positions between the first sealing plate and the second sealing plate.

10. The sealing plate assembly according to claim 9, wherein the fixing portion comprises:

a fixing block, provided with a through hole; and a locking lever, penetrating the through hole to engage the first sliding chute;

wherein, the locking lever abuts against the two sides of the first sliding chute when rotating to a preset angle.

11. The sealing plate assembly according to claim 7, wherein at least one sliding support is arranged on the first sealing plate;

the sliding support further comprises:

a connecting portion, arranged on the first sealing plate; and a stop portion, arranged on the connecting portion;

wherein, the stop portion is wider than the connecting portion; and the second sealing plate is provided with a sliding chute, and the sliding chute is configured to engage the sliding support to cause a relative sliding between the first sealing plate and the second sealing plate.

12. The sealing plate assembly according to claim 8, wherein at least one sliding support is arranged on the first sealing plate;

the sliding support comprises:

a connecting portion, arranged on the first sealing plate; and a stop portion, arranged on the connecting portion;

wherein, the stop portion is wider than the connecting portion; and the second sealing plate is provided with a sliding chute, and the sliding chute is configured to engage the sliding support to cause a relative sliding between the first sealing plate and the second sealing plate.

13. The sealing plate assembly according to claim 7, wherein the first sealing plate, the second sealing plate and the sealing plate joint have the same width.

14. The sealing plate assembly according to claim 13, further comprising:

bent structures, arranged on two sides of the first sealing plate and facing a middle of the first sealing plate;

convex ribs, arranged at the ends of the bent structures and extending toward the second sealing plate; and grooves, arranged on two sides of the second sealing plate, the convex ribs being configured to engage the grooves.

15. The sealing plate assembly according to claim 7, wherein the first sealing plate, the second sealing plate and the sealing plate joint have the same width.

16. The sealing plate assembly according to claim 7, further comprising: a fixing portion, arranged on the second sealing plate for fixing relative positions between the first sealing plate and the second sealing plate.

17. The sealing plate assembly according to claim 16, wherein the fixing portion comprises:

a fixing block, provided with a through hole; and a locking lever, penetrating the through hole to engage the first sliding chute;

wherein, the locking lever abuts against the two sides of the first sliding chute when rotating to a preset angle.

18. An air conditioner, comprising:

an air conditioner body;

an air duct, having one end connected to the air conditioner body; and a sealing plate assembly further comprising:

a first sealing plate;

a second sealing plate, mounted on one side of the first sealing plate, wherein the first sealing plate and the second sealing plate can slide relatively;

a sealing plate joint, mounted on the first sealing plate, located at one end of the first sealing plate opposite to another end of the first sealing plate where the second sealing plate slides out of the first sealing plate, and provided with a vent hole;

a connector for connecting the first sealing plate to the sealing plate joint, wherein the first sealing plate and the sealing plate joint can rotate relatively by taking the connector as the axis;

a first sliding chute, arranged in the first sealing plate;

a second sliding chute, arranged in the sealing plate joint to engage the first sliding chute;

a latch, matched with the first sliding chute and the second sliding chute; and a stop plate, arranged on the first sealing plate and located at a side opposite the first sliding chute, a third sliding chute being arranged in the middle of the stop plate, and part of the first sliding chute being configured to engage the third sliding chute; and wherein the latch is longer than the second sliding chute, and the latch can access or retreat from the first sliding chute when the sealing plate joint is rotated to be parallel to the first sealing plate; the part of the first sliding chute matched with the third sliding chute penetrates the first sealing plate, and the latch penetrates part of the first sliding chute to engage the third sliding chute, and the vent hole is connected to another end of the air duct.

* * * * *